United States Patent [19]

Boguslawski

[11] Patent Number: 4,726,517

[45] Date of Patent: Feb. 23, 1988

[54] PROCESS AND PLANT FOR ELIMINATION OF FOG FROM THE ATMOPSHERE

[76] Inventor: Zbigniew Boguslawski, Frankfurter Strasse 167, D-6078, Neu Isenburg, Fed. Rep. of Germany

[21] Appl. No.: 61,002

[22] PCT Filed: Dec. 8, 1984

[86] PCT No.: PCT/EP84/00393

§ 371 Date: Oct. 15, 1985

§ 102(e) Date: Oct. 15, 1985

[87] PCT Pub. No.: WO85/02637

PCT Pub. Date: Jun. 20, 1985

Related U.S. Application Data

[63] Continuation of Ser. No. 768,099, Oct. 15, 1985, abandoned.

[30] Foreign Application Priority Data

Dec. 12, 1984 [DE] Fed. Rep. of Germany ..... 3344809

[51] Int. Cl.[4] ..... A01G 15/00; C09K 3/00

[52] U.S. Cl. ..... 239/2.1; 239/14.1; 252/194

[58] Field of Search ..... 239/2.1, 14.1; 252/194

[56] References Cited

U.S. PATENT DOCUMENTS

| | | | |
|---|---|---|---|
| 2,052,626 | 9/1936 | Houghton, Jr. | 239/2 R |
| 2,176,851 | 10/1939 | Brewer et al. | 252/194 X |
| 2,700,537 | 1/1955 | Pennington | 252/194 X |
| 3,766,079 | 10/1973 | Jackman | 252/194 X |
| 4,402,862 | 9/1983 | Clark | 252/194 X |

FOREIGN PATENT DOCUMENTS

| | | |
|---|---|---|
| 1005304 | 3/1957 | Fed. Rep. of Germany . |
| 2016863 | 10/1971 | Fed. Rep. of Germany . |
| 1514726 | 2/1968 | France . |

OTHER PUBLICATIONS

Letter to Commissioner of Patents from Edmond Jefferay, made available for public inspection, 8/18/1975.

*Primary Examiner*—Andres Kashnikow
*Assistant Examiner*—Patrick N. Burkhart
*Attorney, Agent, or Firm*—Robert J. Koch

[57] ABSTRACT

Process wherein air is continuously sucked and returned in a closed cycle, the moisture of the air being reduced down to a value lower than the saturation limit value. The treatment is carried out by means of a metal carbide, preferably calcium carbide and/or a substance capable of binding water by hydrolysis or hydration, for example sodium hydrophosphate or anhydrous sodium sulfate which may be contained when mixing both substances into a quantity up to 85% by weight, preferably 35 and 65% by weight, in the substance reacting with the condensed moisture. The plant is comprised of a system of conduits (1–5) containing suction nozzles and connected to a container (7, 8) intended to receive the material reacting with the air moisture and connected to the suction nozzle of a fan (6) to which is coupled a pressure line (1–5) surrounding the limited area and comprising discharge openings.

13 Claims, 3 Drawing Figures

PROCESS AND PLANT FOR ELIMINATION OF FOG FROM THE ATMOPSHERE

This application is a continuation of application Ser. No. 768,099, filed Oct. 15, 1985, now abandoned.

The principal patent application No. P 32 47 607.8 concerns a process for the elimination of fog from the atmosphere by spraying a reagent into the atmosphere rendered turbid by fog. The treatment is effected by the spraying of a substance, preferably calcium carbide in a fine distribution, whereby the substance cleaves off a gaseous reaction product with the water droplets forming the fog turbidity in an exothermic reaction. In order to insure long term freedom from fog, in one form of embodiment of the invention according to the principal patent, the substance may contain one or more substances capable of binding water in an exothermic reaction by means of hydrolysis and/or hydration, for example, sodium sulfate, sodium hydrophosphate, sodium carbonate, barium oxide, silicon chloride and the like, which are free of water of crystallization.

The process according to the principal patent has fully proved its value. However, the free spraying of solid or liquid reaction products (for example, if calcium carbide is used, a substance forming limestone) is seen as a disadvantage in cases wherein the area being treated is a terrain that cannot be kept free of persons or equipment during the spraying period, or only with great difficulty. This may be the case, for example, with road crossings inside and outside of cities, airport approach areas, access roads to ports, stadiums and similar smaller defined areas.

The object of the present invention is to provide a process and an apparatus whereby, while based on the process of the principal patent, the elimination of fog, and optionally its prevention, becomes possible without the creation of residues. The invention consists of the following: the air present in the defined area is suctioned off and returned continuously in a closed circulation loop; which air is conducted on its circulating path through a vessel containing the substance and its humidity extracted down to a value located below its saturation limit.

The invention provides a process whereby a longer lasting (if necessary, unlimited) preventive freedom from fog in defined areas may be obtained at a low cost, without reagents being sprayed into the air and consequently no undesirable reaction products being emitted into the atmosphere. In view of the immediate recycling of the air in equal volumes, no reduced pressures are created to cause the refogging of the area being treated from the environment. In contrast, as a result of the increase in volume due to the exothermic reaction, a displacement of the fog-laden atmosphere into areas outside the section being treated takes place. The defogging or the preventive effect is further enhanced by the heating of the air by the exothermic reaction. The resultant increase in volume decreases the relative humidity of the air disproportionally. This significantly increases the ability of the air to absorb water, which accelerates the removal of the fog and further improves the preventive effect by countering the generation of foggy turbidities.

To remove fog already formed, the treatment is effected advantageously by means of a metal carbide, preferably calcium carbide, over which the air is conducted in a reaction vessel. The reaction vessel may contain as an additive an organic substance containing nitrogen and hydrogen, for example, an azane, diazane, triazane, or tetraazane, an azene, diazene, triazene or tetraazene, a triazdiene or tetraazdiene, also azo- or diazomethane, formic acid, methylhadrazine, oxalic acid, dimethylperoxide, in their pure form or as salts. To remove relative atmospheric humidity and thus prevent the fogging of an area, the treatment is effected advantageously by means of a substance binding water by hydrolysis or hydration, preferably sodium sulfate, sodium hydrophosphate, sodium carbonate, barium oxide, silicon chloride or the like, said substances being free of water of crystallization. Obviously, a mixture of two substances may also be used. It may contain substances binding water by hydrolysis or hydration in amounts of up to 85% by weight, preferably between 35 and 65% by weight. The same overall results may be obtained by carrying out the process steps or, alternatively, in a manner such that in separate working cycles the humidity causing the fog turbidity is extracted from the air by means of treatment with a material cleaving off a gaseous reaction product in an exothermic reaction with water droplets and/or its relative humidity reduced by means of a substance binding water by hydration or hydrolysis.

To buffer the reaction, the substances may further contain materials indifferent to water, for example, alkali or alkaline earth carbonates, such as calcium carbonate or sodium carbonate.

The apparatus to carry out the process according to the invention consists in keeping with the invention of a plurality of conduits comprising a system of suction nozzles extending over the limited area. The conduits all connected by means of a blower with a vessel serving to contain the material reacting with the humidity of the air, with a line comprising a system of discharge orifices further being connected with said vessel. It is advantageous to locate the suction and blower conduits adjacent to each other and in an essentially parallel manner, with the suction and discharge orifices being arranged so that the air is suctioned in an essentially horizontal direction from the surrounding area and discharged in an essentially vertical direction into the limited area. In this manner, optimum air suction and air circulation is obtained because the humidity laden air is suctioned from the layers near the ground, which air has been heated and depleted of its humidity. It is thereby rendered capable of absorbing a high relative humidity and is returned into the layers located above it. In view of the tendency of the heated air to flow upwards, highly absorbent air corridors are formed simultaneously in the boundary zones of the area being treated, which prevents refogging from laterally outside areas.

Optimum definition of the area to be treated and an optimum conduct of the process in relation to the air masses to be circulated are obtained by laying out the suction and blower conduits in an essentially closed ring surrounding the area to be maintained free from fog in ground vicinity.

The invention will become more apparent from the examples below with respect to the drawing attached hereto. In the drawing.

EXAMPLE 1

Figure 1:
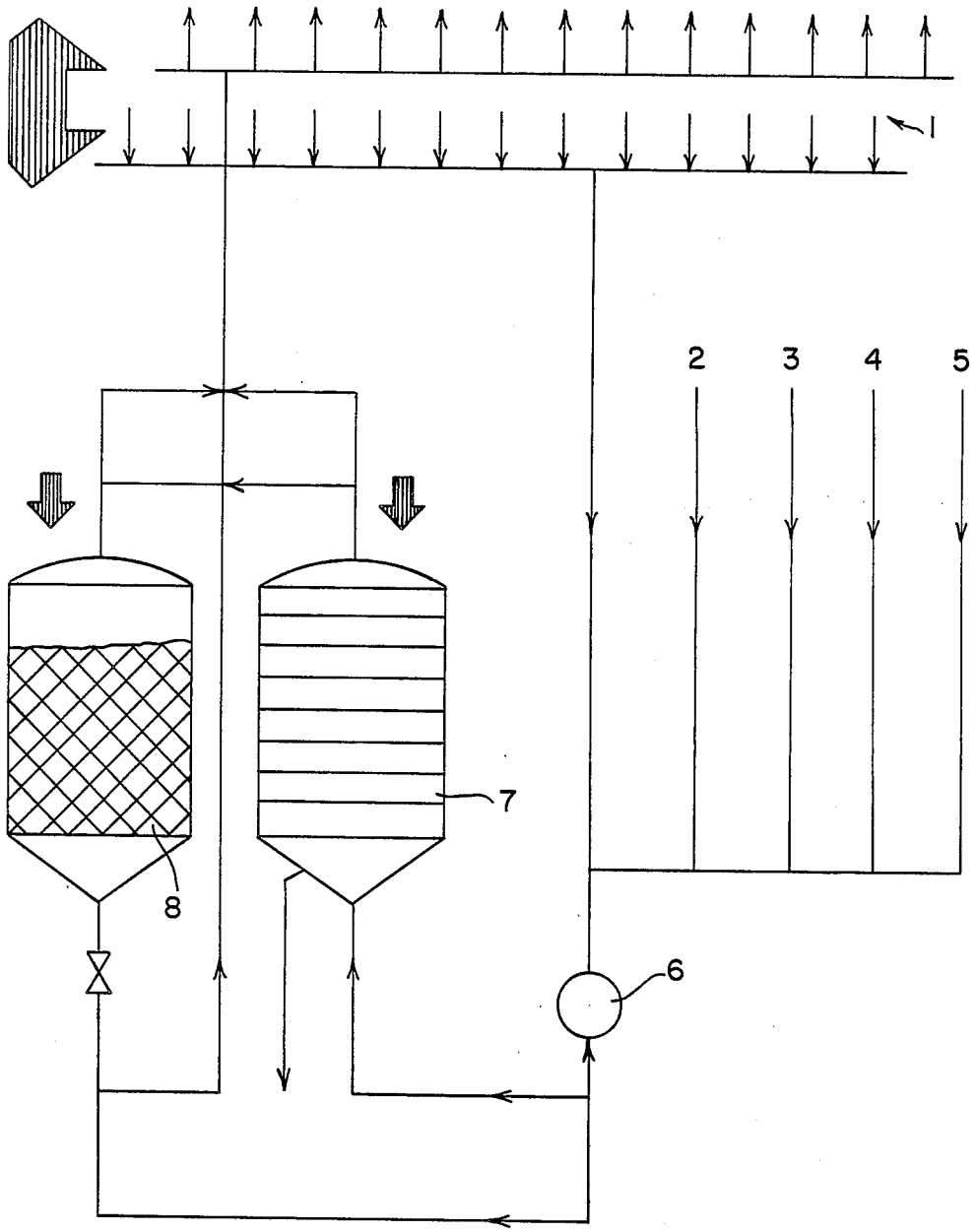
FIG. 1 shows a schematic view of an installation for the selective removal of an existing fog or the prevention of the formation of the fog within a limited area.

An airfield apron with the dimensions of 50×30×15 m (22,500 $m^3$) is to be freed of fog in calm air for an undetermined period of time. A stationary plant is installed, consisting (FIG. 1) of two stationary reaction vessels 7 and 8, a circulating blower 6 and a system of suction and discharge conduits 1, 2, 3, 4, 5 comprising a plurality of suction nozzles and discharge orifices installed stationarily, but adjustably in height by approximately 15 m. The conduits consist of a synthetic plastic or a light metal and are distributed adjacent to each other at a uniform distance over the active field for example 8 to 10 m. The tubular structure is supported and displaced by a jacking system or a light metal structure. The suction conduits have suction fittings directed downward, and the discharge conduits have discharge fittings directed upward, with the suction and discharge lines having the configuration of twin tubes.

The foggy air is suctioned in by the suction conduits of the twin tubes 1, 2, 3, 4, 5 with the aid of the blower 6. The blower may have a capacity of 22,500 $Nm^3/h$ or 45,000 $Nm^3/h$ or more which is a function of the period of time within which the defogging of the area is to be achieved. The suctioned in air is circulated first for the removal of the humidity of the fog in the reactive vessel 7, which is filled with ground carbide. Subsequently, to reduce its relative humidity, it is circulated in the reaction vessel 8, which is filled with finely powdered sodium sulfate. It is then returned to the area being treated through the discharge conduits of the twin line in the form of clear air heated by the exothermic reaction in the vessel 7. The conduits in the twin tubes have a diameter of 324 (or 460). The collector tubes have a diameter of 750 (or 1,000) mm. The amount of chemicals required depends on the concentration of the fog. The reaction vessels have diameters of 2000/3500 mm.

EXAMPLE 2

Figure 2:
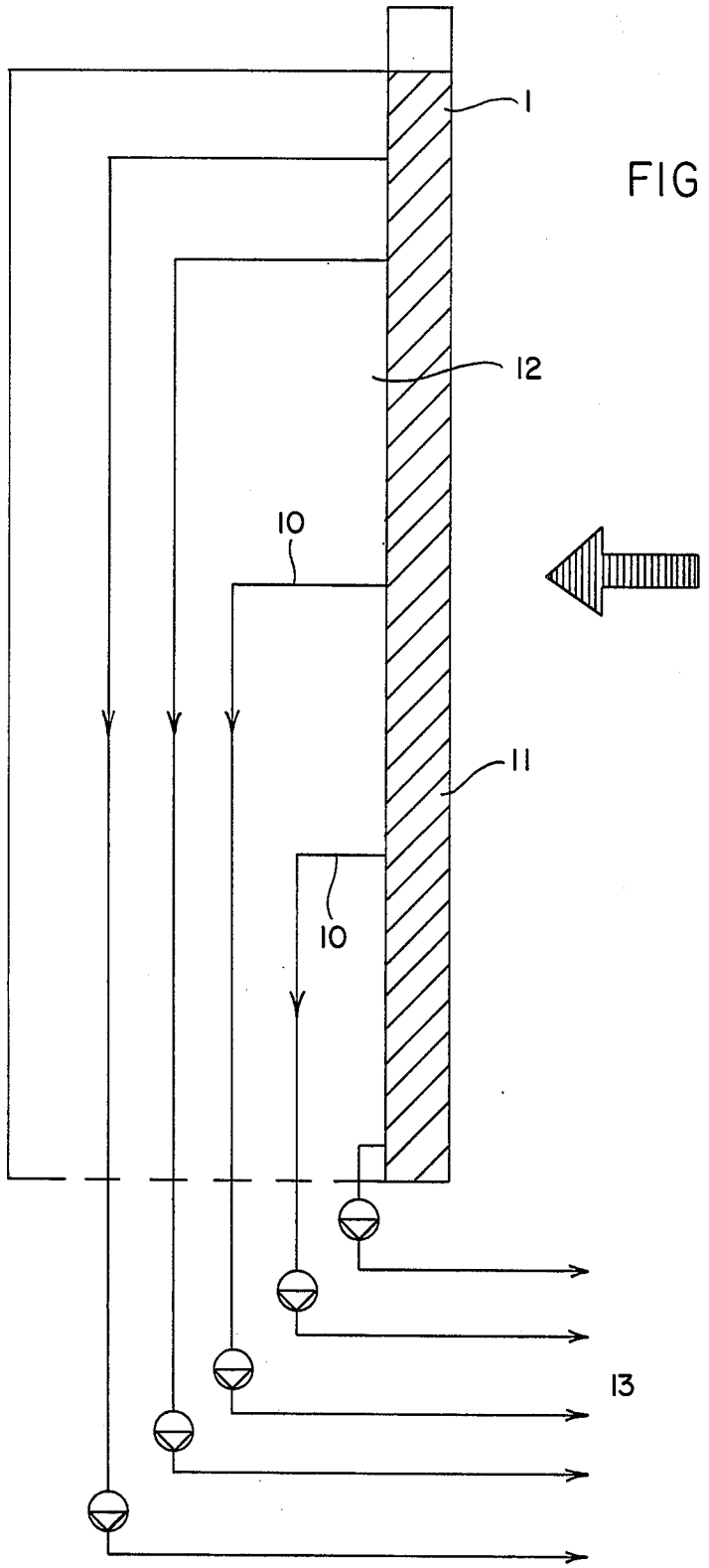
FIG. 2 is a further form of embodiment of an installation for the elimination of creeping fog in a schematic view.

An airfield apron, such as that of Example 1, is to be freed of creeping fog. The installation of Example 1 is used, but a supplemental apparatus (FIG. 2) is installed into the area being treated on the inflow side of the fog. The supplemental apparatus consists of a plurality of suction lines 10 arranged adjacently to each other and connected with the suction conduit of a blower system. The supplemental apparatus suctions air from the corridor 11 which is located on the inflow side of the area to be maintained fee of fog. The suction capacity depends on the flow velocity of the creeping fog and is calculated at with an inflow velocity of 0.5 m/sec—1,350,000 $m^3/h$
with an inflow velocity of 1.0 m/sec—2,700,000 $m^3/h$
with an inflow velocity of 1.5 m/sec—4,050,000 $m^3/h$.

In the case of creeping fog, the process may be effected by operating the supplemental apparatus on the inflow side of the area to be treated with a capacity to include all of the inflow volume. Thus, the air suctioned from the preceding corridor 11 is conducted into a space 13 located outside the area 12 treated, and the area being treated is defogged in the manner described in Example 1. This method is expensive and must be evaluated from an economic standpoint in each particular case.

EXAMPLE 3

An airfield apron, such as in Example 1, is to be protected preventively against the occurrence of fog. The indication of humidity approaches saturation at 100%. The installation of Example 1 is operated, but with the objective of maintaining continuously a saturation limit of 95%. The blower 6 now supplies only the reaction vessel 8.

EXAMPLE 4

A soccer field of 100×100×20 (200,000 $m^2$)m is to be defogged and also protected preventively against fog. The mode of operation of FIG. 1 is applied, but with the difference that the upwardly adjustable single twin tube is moved as a mobile installation mounted on a trailer with a displaceable stage, having a working width of 10 to 15 m, on paths over the entire field. With a traveling velocity of 5 km/h, the soccer field is completely defogged in (10 times 100 m: 5000 m)×1 h×60 min/h=12 min. In view of the large volume, the defogging action is extended to one hour, whereby the output of the circulating blower may be reduced to approximately 40,000 $Nm^3/h$.

EXAMPLE 5

Figure 3:
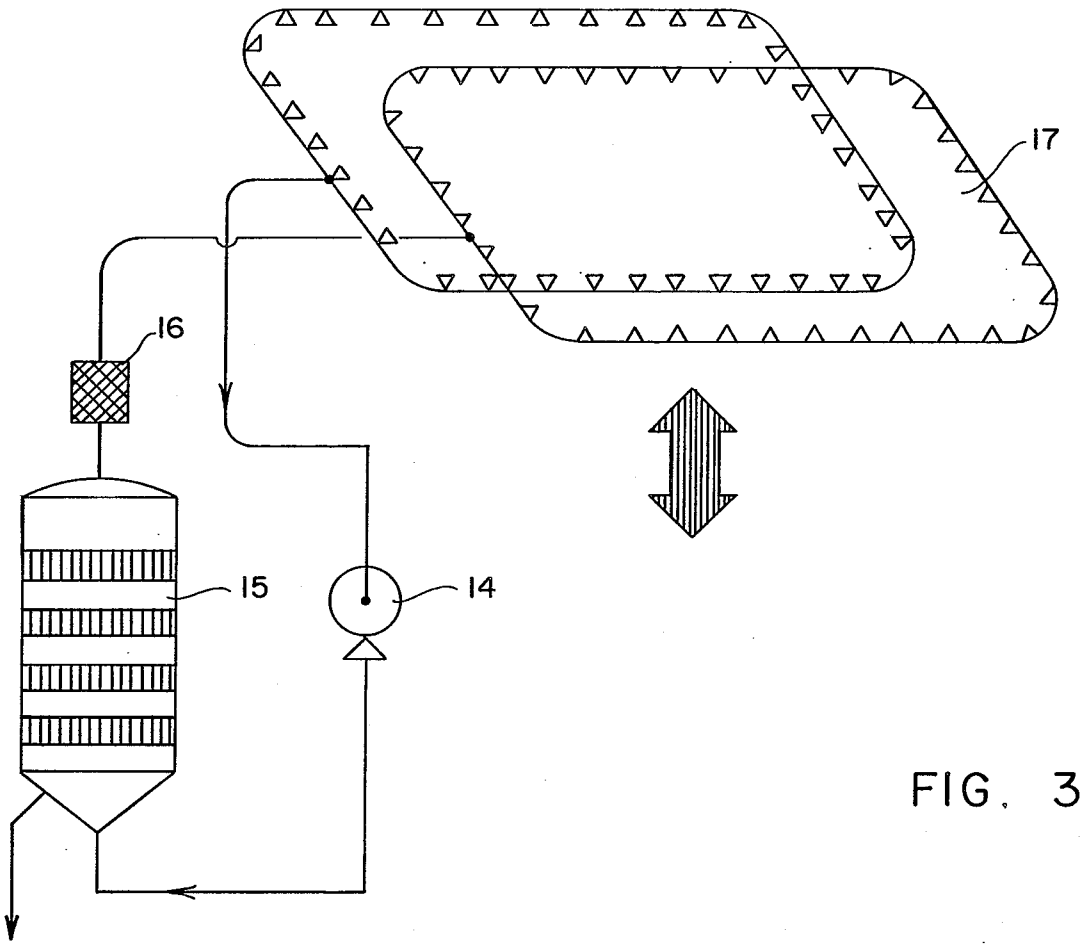
FIG. 3 is a further form of embodiment of an installation for the elimination of fog in a schematic view.

In a large city a pedestrian crossing in the center of town is to be maintained free of fog continuously. The space to be defogged is 5×30×5 m (750 $m^2$). A stationary defogging installation is erected from its elements or a mobile unit is used. Annular twin tubes in a rectangular configuration are moved from top to bottom and the passage is freed of fog. In case of a persistent fog, the annular twin tubes are displaced at regular intervals. The air is suctioned in by the blower 14 (FIG. 3.) and conducted through the reaction vessel 15 and the filter 16 into the discharge conduit of the annular twin tubes 1.

I claim:

1. A process for elimination of fog over a limited surface area comprising the steps of:
   - continuously suctioning fog-containing air from a limited predetermined surface area at a plurality of locations;
   - circulating suctioned air in a closed circulation loop through a treatment vessel;
   - treating said suctioned air within said vessel with a metal carbide to reduce fog turbidity by exothermic reaction between said metal carbide and water droplets in the fog to yield a gaseous reaction product;
   - contacting said treated air with a substance capable of binding water by hydrolysis or hydration to lower the humidity level of the suctioned air to below the saturation level; and
   - returning said treated air to a plurality of locations within said predetermined area.

2. Process according to claim 1, wherein said treatment step is preferably carried out with calcium carbide, with a grain size between 1 mm and 150 mm.

3. Process according to claim 2, further comprising the step of continuously agitating the carbide or in regular intervals mechanically by agitators or by compressed air to mechanically free the surface of the grains from reaction products in order to maintain full reactivity.

4. Process according to claim 2, characterized in that the calcium carbide contains for the binding of the phosphate ($PH_3$) possibly also formed in the reaction, one or several salts with a lower redox potential than phosphine, for example, silver nitrate or copper sulfate.

5. Process according to claim 1, characterized in that the substance contains as an additive an organic substance comprising nitrogen and hydrogen, for example, an azane, diazane, triazane, or tetraazane, an azene, diazene, triazene or tetraazene, a triazdiene or tetraazdiene, also azo- or diazomethane, formic acid, methylhadrazine, oxalic acid, dimethylperoxide, in their pure form or as a salt.

6. Process according to claim 1, characterized in that the substance contains as the substances binding water by hydrolysis or hydration anhydrous sodium sulfate, sodium hydrophosphate, sodium carbonate, barium oxide, silicon chloride or the like.

7. Process according to claim 6, characterized in that the substances binding water by hydrolysis or hydration are contained in the substance reacting with the condensed humidity in amounts of up to 85% by weight, preferably between 35 and 65% by weight.

8. Process according to claim 1, characterized in that to buffer the reaction, the substance contains materials indifferent to water, for example, alkali or alkaline earth carbonates, such as calcium carbonate or sodium carbonate.

9. Process according to claim 1, characterized in that in separate work cycles the humidity causing the foggy turbidity is extracted from the air by treatment with a material forming in an exothermic reaction with water droplets a gaseous reaction product and/or its relative humidity reduced by means of a substance binding water by hydration or hydrolysis.

10. Process according to claim 1, further comprising the step of preventing penetration of creeping fog into the area being treated by suctioning air off an inflow side of said surface area and discharging the air in an area outside the area being treated.

11. Apparatus for the embodiment of the process according to claim 1, characterized by a system of conduits extending over a limited area and comprising a system of suction nozzles, connected by means of a blower with a vessel serving to contain the material reacting with the atmospheric humidity, which in turn is connected with a conduit encompassing the limited area and comprising a plurality of discharge orifices.

12. Apparatus according to claim 11, characterized in that the suction and discharge conduits are laid out adjacent to each other in an essentially parallel manner and that the suction and discharge orifices are arranged so that the air is suctioned in from the limited area in an essentially horizontal direction and is discharged into the limited area in an essentially vertical direction.

13. Apparatus according to claim 11, characterized in that the suction and discharge conduits form an essentially closed, vertically adjustable annulus surrounding the limited area to be maintained free of fog in the vicinity of the ground.

* * * * *